United States Patent [19]

Abt et al.

[11] Patent Number: 4,580,498

[45] Date of Patent: Apr. 8, 1986

[54] FUZE ACTUATING SYSTEM HAVING A VARIABLE IMPACT DELAY

[75] Inventors: Edgar J. Abt, Tempe; Arlie A. Ramsey, Scottsdale, both of Ariz.

[73] Assignee: Motorola, Inc., Schaumburg, Ill.

[21] Appl. No.: 402,389

[22] Filed: Jul. 27, 1982

[51] Int. Cl.[4] ..... F42C 11/06

[52] U.S. Cl. ..... 102/215; 102/206

[58] Field of Search ..... 102/215, 216, 206, 262, 102/265, 266

[56] References Cited

U.S. PATENT DOCUMENTS

| | | | |
|---|---|---|---|
| 3,067,684 | 12/1962 | Euker et al. | 102/206 |
| 3,500,746 | 3/1970 | Ambrosini | 102/215 |
| 3,613,589 | 10/1971 | Apstein | 102/263 |
| 3,646,371 | 2/1972 | Flad | 102/215 |
| 3,703,145 | 11/1972 | Burkhardt et al. | 102/270 |
| 4,026,215 | 5/1977 | Ziemba et al. | 102/215 |
| 4,236,157 | 11/1980 | Goss et al. | 102/214 |
| 4,240,350 | 12/1980 | Munzel et al. | 102/215 |
| 4,267,776 | 5/1981 | Eickerman | 102/215 |
| 4,320,704 | 3/1982 | Gawlick et al. | 102/218 |
| 4,387,649 | 6/1983 | Weidner et al. | 102/215 |

*Primary Examiner*—Charles T. Jordan

*Attorney, Agent, or Firm*—Eugene A. Parsons

[57] ABSTRACT

A fuze having an impact delay implemented by strobing the count from a time-of-flight counter to set a down counter after an impact is sensed and then decrementing the down counter to a predetermined count at which point a firing signal is passed.

15 Claims, 7 Drawing Figures

FUZE ACTUATING SYSTEM HAVING A VARIABLE IMPACT DELAY

BACKGROUND OF THE INVENTION

The present invention pertains in general to fuze actuating systems and in particular to fuze actuating systems comprising a timer having a variable impact delay.

In the design of projectile fuzes for impact function it is often desirable to provide for detonation of the projectile within the target, such as an aircraft structure, rather than at the instant of first contact with the target. This can be accomplished in myriad ways, ranging from a simple non-varying delay time between first impact and detonation to a delay time that is dependent upon the dynamics and geometry of projectile approach to and interaction with the target. As the degree of fuzing elegance increases, the production cost of fuze hardware generally increases also.

The time of detonation delay may be varied as a function of projectile flight time to the target. Because the latter is a known function of projectile velocity, detonation delay becomes a function of projectile velocity at target impact. In turn, the depth to which a projectile invades the target media before detonating can be controlled within reasonable bounds by increasing the detonation delay time of the fuze as range to the target increases.

The invention is particularly suited for use in fuzes for "fixed" ammunition in the direct fire mode. For example, the technology of this invention is amenable to ammunition for modern anti-aircraft gun systems in the size range 25 to 40 mm. Both nose mounted and base mounted fuzes can use the technique to enhance the performance of the ammunition.

In one approach to providing impact delays in electronic fuzes, as illustrated by U.S. Pat. No. 4,240,350, issued to K. Munzel, P. Karayannis and H. Naef, a fixed delay is provided by means of an arrangement of logic gates. However, the timer used in this approach requires two oscillators, one for barrel safety and one for the impact delay, and yet only provides a fixed impact delay. Therefore this approach does not allow optimal target penetration.

In yet another approach to providing electronic impact delays, a variable delay of U.S. Pat. No. 4,320,704, issued to H. Gawlick, U. Brede, and H. Bendler, is implemented by charging a capacitor to a degree determined by the flight time of a projectile as an integration of flight time and then discharging the capacitor through a resistance after impact in order to provide a delay related to flight time before detonation. However, an extremely steady current source is required for such an impact delay system to be accurate. Meeting the sorts of tolerances required is extremely difficult in a mass-produced fuze. Furthermore, such a fuze is not readily programmable.

SUMMARY OF THE INVENTION

Accordingly it is an object of the present invention to provide a new and improved fuze actuating system having a variable impact delay.

It is a further object of the present invention to provide a fuze actuating system having a variable impact delay which is electronically implemented to conserve space and spare expense.

Yet a further object is to provide a fuze actuating system having a variable impact delay which can accurately compensate for the loss of velocity that is concommitant with increased flight time of some projectiles.

Another object of the present invention is to provide a fuze actuating system having a variable impact delay fuze timer which is self-contained and therefore not susceptible to electronic jamming.

Among the advantages of the present invention are the enhanced terminal effects achievable by using electronics that occupy negligible volume.

Another advantage of the present invention is its relatively low cost as compared to other impact delays, the cost being limited to that portion of an IC chip devoted to the impact delay function.

Yet another advantage of the present invention is the low current drain on the power supply.

A further advantage is the flexibility arising from the ability to preset a variety of self-destruct times at the factory.

These and other objects and advantages of the present invention will become apparent to those skilled in the art upon consideration of the accompanying specification, claims and drawings.

In order to attain the above mentioned and other objects and advantages the apparatus according to the present invention involves a timer for a fuze actuation system having an output circuit and having an impact sensor. The timer comprises an oscillator coupled to a frequency divider which is in turn coupled to a time-of-flight counter. An arming latch is coupled to the time-of-flight counter, while an impact latch is coupled to the arming latch and to the impact sensor. A strobe control, a ripple counter, a minimum delay decoder and a down counter are all coupled to the impact latch. Each of a plurality of data gates is coupled to the strobe control as is the ripple counter and the minimum delay decoder. Each of the plurality of data gates is also coupled to the time-of-flight counter and to the down counter. The ripple counter is coupled to the oscillator, to the minimum delay decoder and to the down counter, while the down counter is itself coupled to the minimum delay decoder.

The method according to the present invention involves delaying detonation of a fuzed projectile after an impact of the projectile with an object, the fuze having a time-of-flight counter providing an output count and having a down counter having a settable count and providing a firing signal at a predetermined count. The method comprises the steps of gating the count from the time-of-flight counter to the down counter after impact, setting the settable count of the down counter using the count gated from the time-of-flight counter and decrementing the down counter to the predetermined count.

DESCRIPTION OF THE PREFERRED EMBODIMENT

Figure 1:
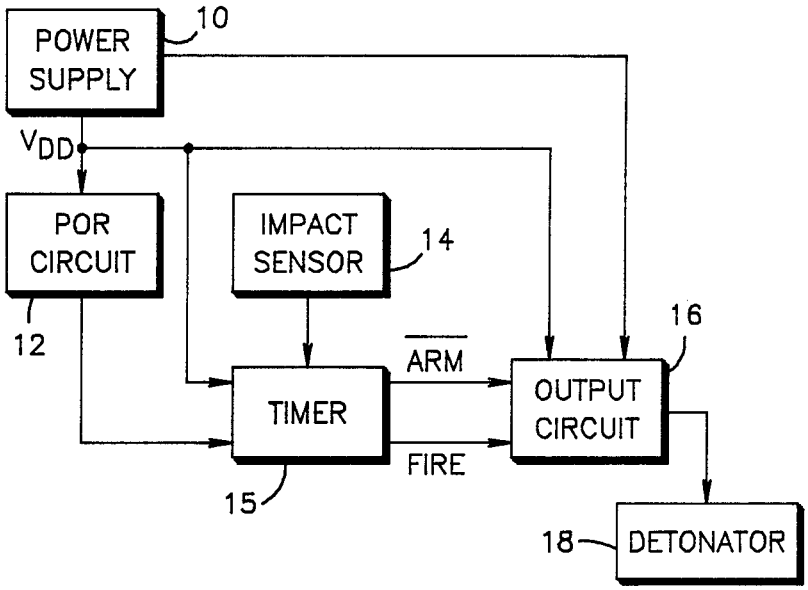
FIG. 1 is a block diagram of a fuze according to the present invention.

In a fuze actuation system, as shown in FIG. 1, a power supply 10 provides a low level of regulated voltage, $V_{DD}$, to a power-on-reset circuit 12 and to a timer 15. Power supply 10 provides an output at a higher voltage to an output circuit 16. Timer 15 is also coupled to power-on-reset circuit 12 and to an impact sensor 14. Timer 15 provides two outputs to output circuit 16, an arming output and a firing output. An inverted arming output from timer 15 enables and a firing output from timer 15 causes output circuit 16 to connect power supply 10 to a detonator 18 in order to bring about the explosion of a projectile in which the fuze actuation circuit is employed.

Power supply 10 may be either a setback generator or a liquid reserve battery. Power-on-reset circuit 12 may be of the sort described in a co-pending application entitled "Power-On-Reset Circuit," filed on July 20, 1981 by C. Eickerman and A. Ramsey, Ser. No. 284,415 now U.S. Pat. No. 4,409,501, and may be integrated on a single IC chip in CMOS with a timer according to the present invention. Impact sensor 14 may be a piezoelectric impact sensor of the sort that is commonly available to one skilled in the art. Output circuit 16 may be a linear circuit and detonator 18 may be an electrically initiated detonator both of the sort found in existing fuzes and readily utilized by one skilled in the art. Timer 15 is the timing circuit according to the present invention.

Figure 2:
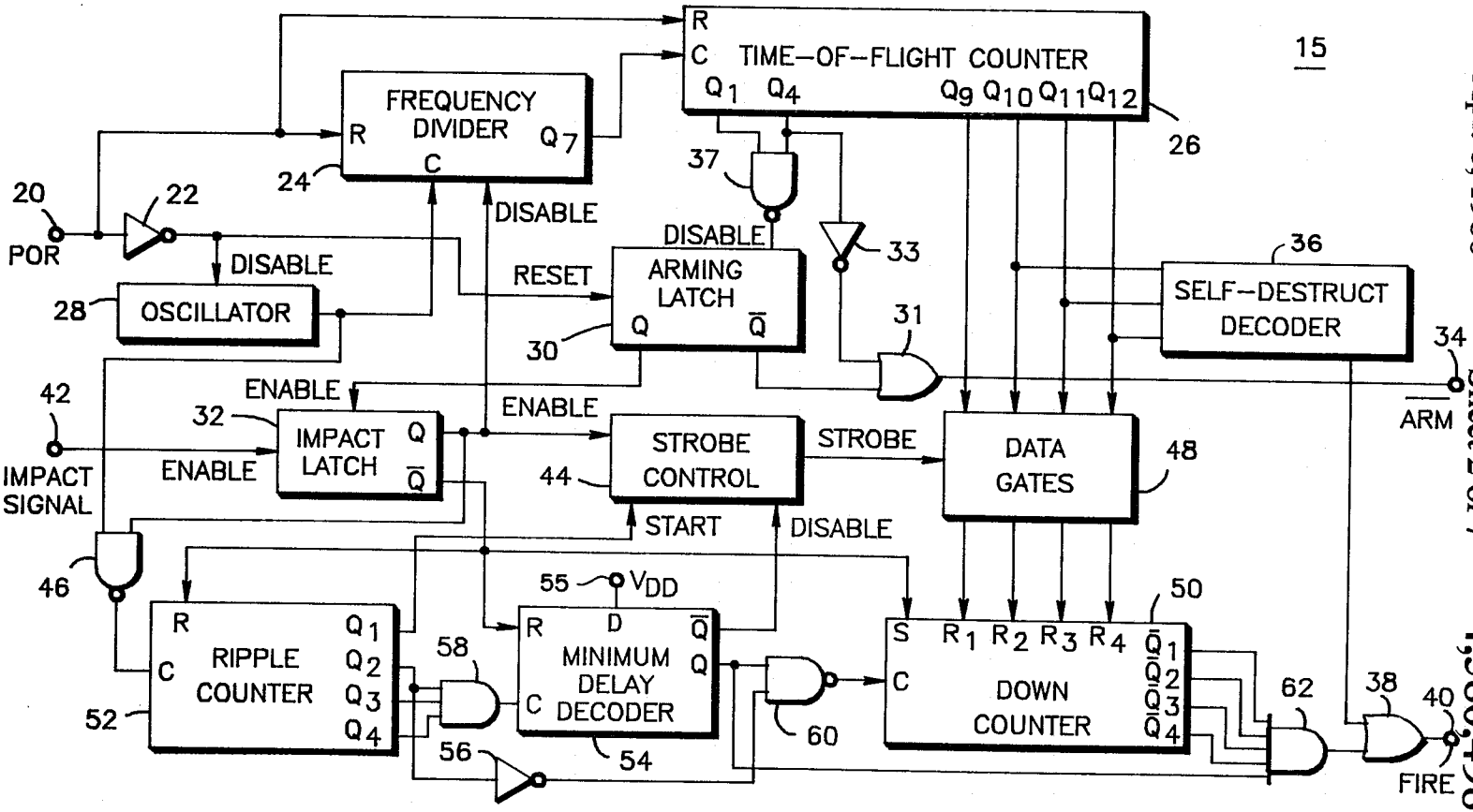
FIG. 2 is a block diagram of a fuze timer having a variable impact delay according to the present invention.

A timer according to the present invention is illustrated in FIG. 2. A terminal 20 for application of a power-on-reset pulse is coupled to an input of an inverter 22, to a reset input of a frequency divider 24 and to a reset input of a time-of-flight counter 26. An output of inverter 22 is coupled to a disabling input of an oscillator 28 and to a reset input of an arming latch 30. A sequenced output, $Q_7$, of frequency divider 24 is coupled to a clock input of time-of-flight counter 26.

A first disabling input of arming latch 30 is coupled to an output of a NAND gate 27 which in turn has a first and a second input respectively coupled to a lower, $Q_1$, and a higher, $Q_4$, sequenced output of time-of-flight counter 26. A Q output of arming latch 30 is coupled to a first enabling input of an impact latch 32 while a $\overline{Q}$ output of latch 30 is coupled to a first input of an OR gate 31, an output of which is coupled to an output terminal 34 for an inverted arming signal. A second input of OR gate 31 is coupled to an output of an inverter 33, an input of which is coupled to the higher sequenced output, $Q_4$, of time-of-flight counter 26.

A self-destruct decoder 36 is coupled to a series of the highest sequenced outputs, $Q_{10}$, $Q_{11}$, $Q_{12}$, of time-of-flight counter 26. An output of self-destruct decoder 36 is coupled to a first input of an OR gate 38 which is in turn coupled to an output for a firing signal 40.

A terminal 42 suitable for application of an impact signal is coupled to a second enabling input of impact latch 32, a Q output of which is coupled to an enabling input of a strobe control 44, to a disabling input of frequency divider 24 and to a first input of a NAND gate 46. An output of strobe control 44 is coupled to a strobe input of a plurality of data gates 48 a plurality of inputs of which are coupled to a series of the high sequenced outputs, $Q_9$, $Q_{10}$, $Q_{11}$, and $Q_{12}$, of time-of-flight counter 26. A plurality of outputs of data gates 48 are coupled to a plurality of reset inputs $R_1$, $R_2$, $R_3$ and $R_4$, of a down counter 50.

An output of oscillator 28 is coupled to an input of frequency divider 24 and to a second input of NAND gate 46, an output of which is coupled to a clock input of a ripple counter 52. A $\overline{Q}$ output of impact latch 32 is coupled to a reset input of ripple counter 52, a reset input of a minimum delay decoder 54 and to a set input of down counter 50. A lowest sequenced output, $Q_1$, of ripple counter 52 is coupled to a start input of strobe control 44 while the next lowest sequenced output, $Q_2$, of ripple counter 52 is coupled both to an input of an inverter 56 and to an input of an AND gate 58. An output of inverter 56 is coupled to a first input of a NAND gate 60. Two highest sequenced outputs, $Q_3$ and $Q_4$, of ripple counter 52 are each coupled to an input of AND gate 58. An output of AND gate 58 is coupled to a clock input of minimum delay decoder 54 while a D input of minimum delay decoder 54 is coupled to a terminal 55 suitable for application of a source of positive potential $V_{DD}$. A $\overline{Q}$ output of minimum delay decoder 54 is coupled to a disabling input of strobe control 44 while a Q output of minimum delay decoder 54 is coupled both to a second input of NAND gate 60 and to a first input of an AND gate 62.

An output of NAND gate 60 is coupled to a clock input of down counter 50, each of the $\overline{Q}$ outputs of which, $\overline{Q}_1$, $\overline{Q}_2$, $\overline{Q}_3$ and $\overline{Q}_4$, is coupled to an input of AND gate 62. An output of AND gate 62 is coupled to a second input of OR gate 38.

In the operation of the embodiment of FIG. 1, setback forces cause activation of power supply 10 which in turn activates power-on reset circuit 12. Power-on reset circuit 12 next supplies a reset pulse to timer 15.

Turning now to the embodiment of the timer shown in FIG. 2, a power-on reset pulse applied at terminal 20 is conducted to reset frequency divider 24 and time-of-flight counter 26. In addition, the power-on reset pulse is inverted in inverter 22 and applied to disable oscillator 28 and to reset arming latch 30.

When the power-on reset pulse ends, the oscillator is no longer disabled and frequency divider 24 and time-of-flight counter 26 are ready to begin counting from a basal level. Time-of-flight counter 26 is clocked at the end of the first series of counts of frequency divider 24 so that output $Q_1$ of time-of-flight counter 26 goes high setting the first input of NAND gate 27 high.

At the eighth clocking of counter 26, output $Q_4$ of time-of-flight counter 26 goes high and at the ninth clocking of counter 26, output $Q_1$ of counter 26 goes high as well. At this stage both inputs of NAND gate 27 are high and the second input of AND gate 31 is low by way of the output of inverter 33, all of these inputs being coupled to outputs of counter 26 which are high. Because all of its inputs are high, the output of NAND gate 27 goes low removing the disablement from the disabling input of arming latch 30. Arming latch 30 then provides a high level output signal to the first enabling input of impact latch 32 and a low level output signal to the second input of OR gate 31. Because at this stage both inputs of OR gate 31 are low, its output goes low and provides an inverted arming signal through terminal 34. In this way, an inverted arming signal is provided after a time-in-flight of a duration fixed by the output of counter 26, latch 30 and OR gate 31.

However, so long as no impact signal is received through terminal 42, the Q output of impact latch 32 remains at its initial low level, so that frequency divider 24 is not disabled and strobe control 44 is not enabled. Likewise, until an impact signal is received, the $\overline{Q}$ output of impact latch 32 remains at its initial high level, so that counter 52 and decoder 54 are maintained in a reset condition and so that down counter 50 is maintained in a set condition.

If no impact signal has been received by the time that the last outputs, $Q_{10}$, $Q_{11}$, and $Q_{12}$, of time-of-flight counter 26 have gone high, the output of self destruct decoder 36 goes high so that at least one input of OR gate 38 goes high. Because at least one of its inputs is high, the output of OR gate 38 goes high to provide a firing signal at terminal 40. By this means the projectile will be caused to destroy itself at a chosen time after arming if no impact has occurred.

If an impact signal is detected due to a collision of the projectile with an object, impact sensor 14, as shown in FIG. 1, provides a high output signal to timer 15 by way of terminal 42, as shown in FIG. 2.

An impact signal received through terminal 42 causes the second enabling input of impact latch 32 to go high so that the outputs of latch 32 are toggled. The Q output of latch 32 goes high disabling frequency divider 24. Consequently, no more clock impulses are fed to time-of-flight counter 26 and counter 26 is stopped. Furthermore, the high level at the Q output of latch 32 enables strobe control 44 and causes the first input of NAND gate 46 to go high. Because the first input of NAND gate 46 is high, whenever the second input of NAND gate 46 is made high by the high cycle of oscillator 28, the output of NAND gate 46 goes low. Alternately, whenever the output of oscillator 28 goes low, not all of the inputs of NAND gate 46 are high so that its output goes high clocking ripple counter 52. Because the $\overline{Q}$ output of latch 32 has gone low, counter 52 and decoder 54 are no longer held in a reset mode and counter 50 is no longer held in a set mode.

At the first clocking of ripple counter 52, output $Q_1$ of counter 52 goes high starting strobe control 44 so that the strobe input of data gates 48 is activated. While they receive the strobe input from control 44, data gates 48 pass the inverse levels of the highest sequenced outputs of counter 26, $Q_9$, $Q_{10}$, $Q_{11}$, and $Q_{12}$, to the respective reset inputs, $R_1$, $R_2$, $R_3$ and $R_4$, of down counter 50.

When the second output, $Q_2$, of ripple counter 52 goes high at the second clocking of counter 52, an input of AND gate 58 and an input of inverter 56 are both made high. Therefore, the output of inverter 56 goes low, driving the first input of NAND gate 60 low. When outputs $Q_3$ and $Q_4$ of ripple counter 52 go high so that outputs $Q_2$, $Q_3$ and $Q_4$ of ripple counter 52 are all high, all inputs of AND gate 58 are made high causing the output of AND gate 58 to go high and to apply a clocking pulse to minimum delay decoder 54. When decoder 54 is clocked, the Q output of decoder 54 goes high and stays high because the D input is held high by the application of a positive potential to terminal 55. Any further clock impulses to decoder 54 do not result in any change in the level of the Q output so that the first input of NAND gate 60 and the first input of AND gate 62 are held high. Just as the Q output of decoder 54 goes high and is held high, the $\overline{Q}$ output of decoder 54 goes low and is held low, disabling strobe control 44. As a result, the strobe input to data gates 48 is removed so that data no longer passes through data gates 48.

When the $Q_2$ output of ripple counter 52 next goes high, in the second cycle of ripple counter 52, the second input of NAND gate 60 goes low so that its output goes high. Down counter 50 is clocked on the rising edge of the output signal from NAND gate 60 so that the first of the $\overline{Q}$ outputs, $\overline{Q}_1$, of down counter 60 goes high. On each of the succeeding cycles of counter 52, down counter 50 is clocked so that another of its $\overline{Q}$ outputs goes high. Thus, after the number of cycles of counter 52 required to count down from the condition as set by the strobed outputs of counter 26, all of the $\overline{Q}$ outputs of counter 50 have gone high. Because all of the outputs of down counter 50 are then high and because the Q output of decoder 54 is then high, all inputs of AND gate 62 are high causing its output to go high. Consequently, the second input of OR gate 38 goes high, and because at least one of its inputs is high its output goes high, providing a firing signal at terminal 40.

DETAILED DESCRIPTION OF THE TIMER

Figure 3A:
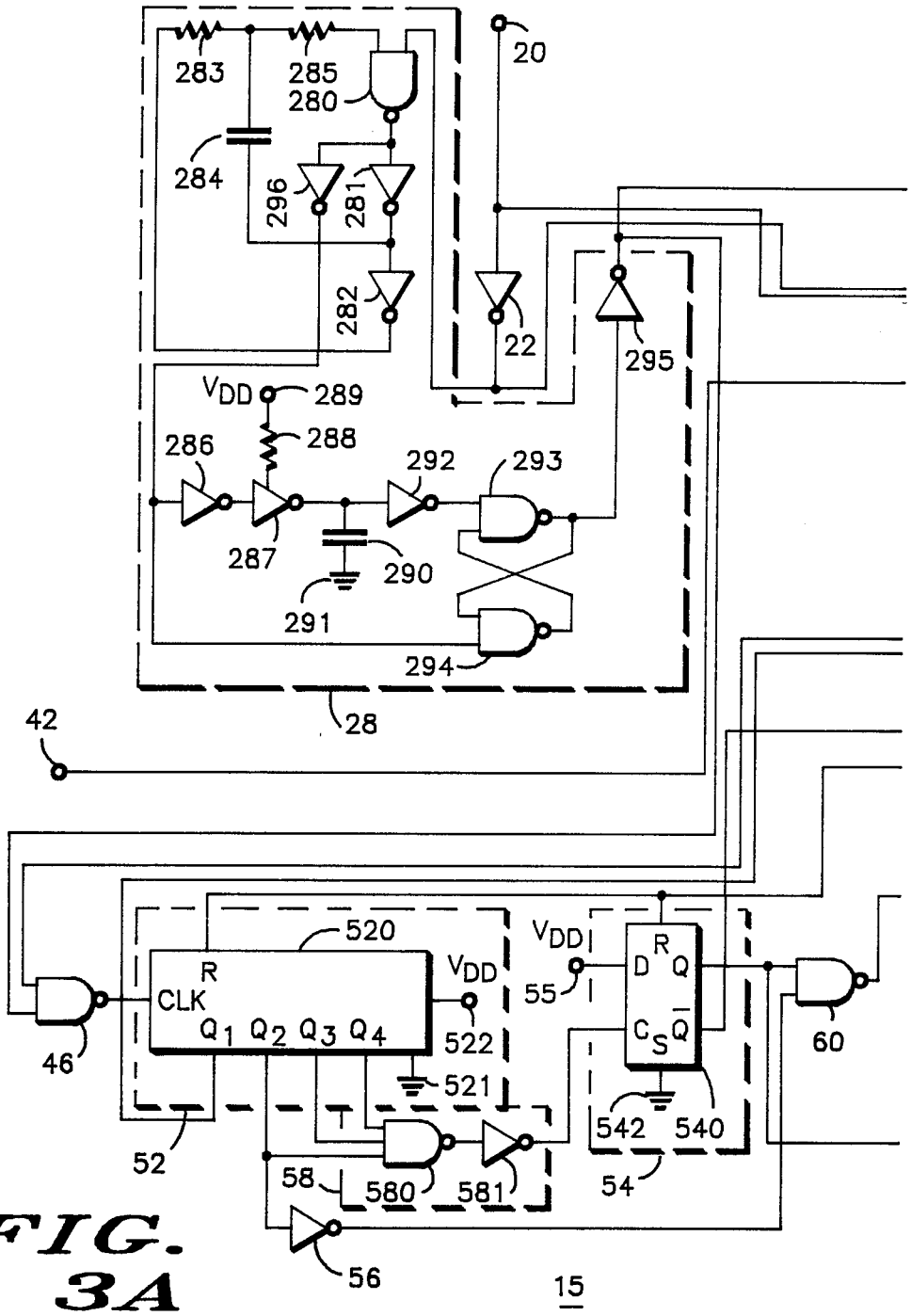
FIG 3A–3C are a schematic diagram of a preferred embodiment of FIG. 2.
Figure 3B:
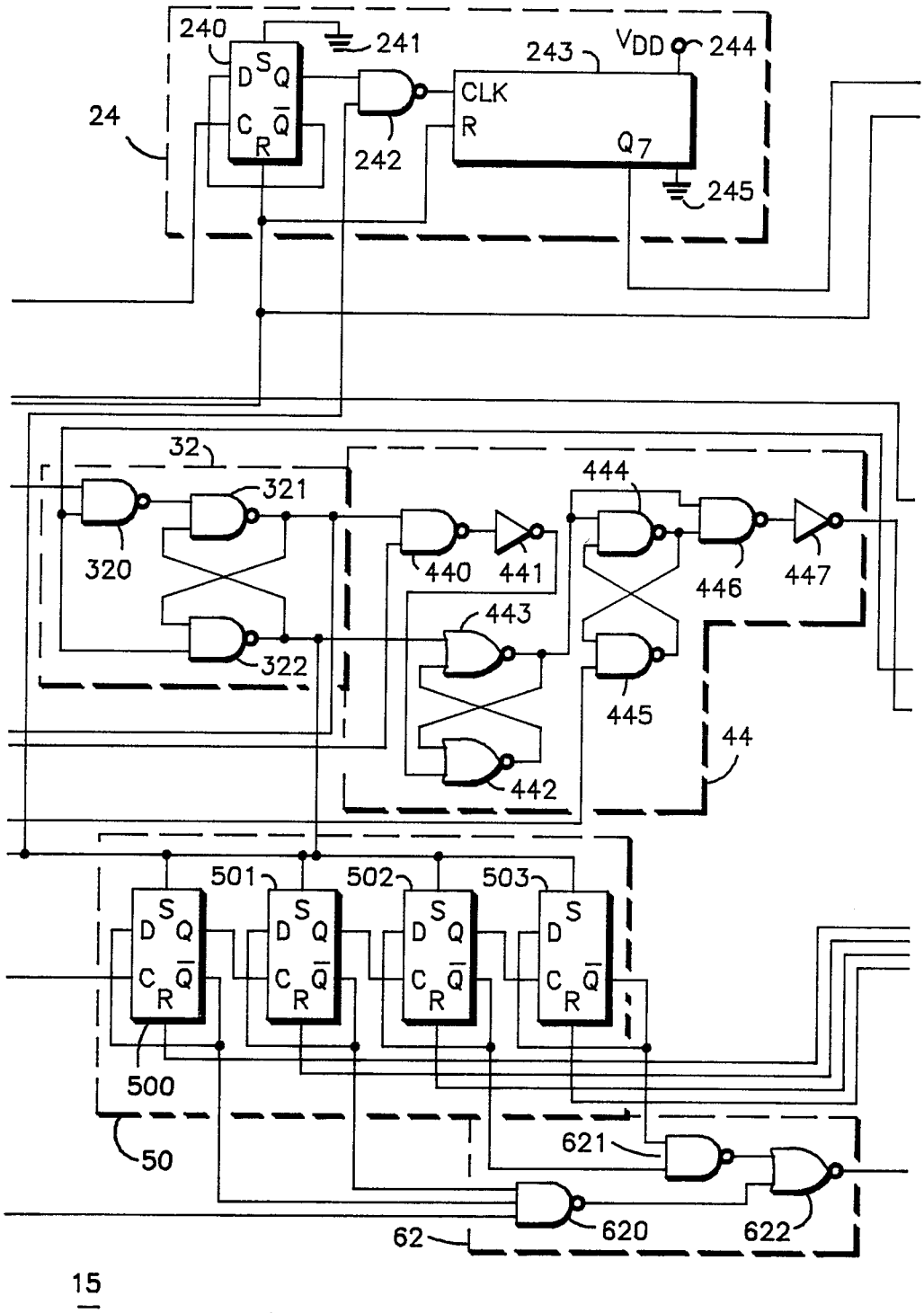
Figure 3C:
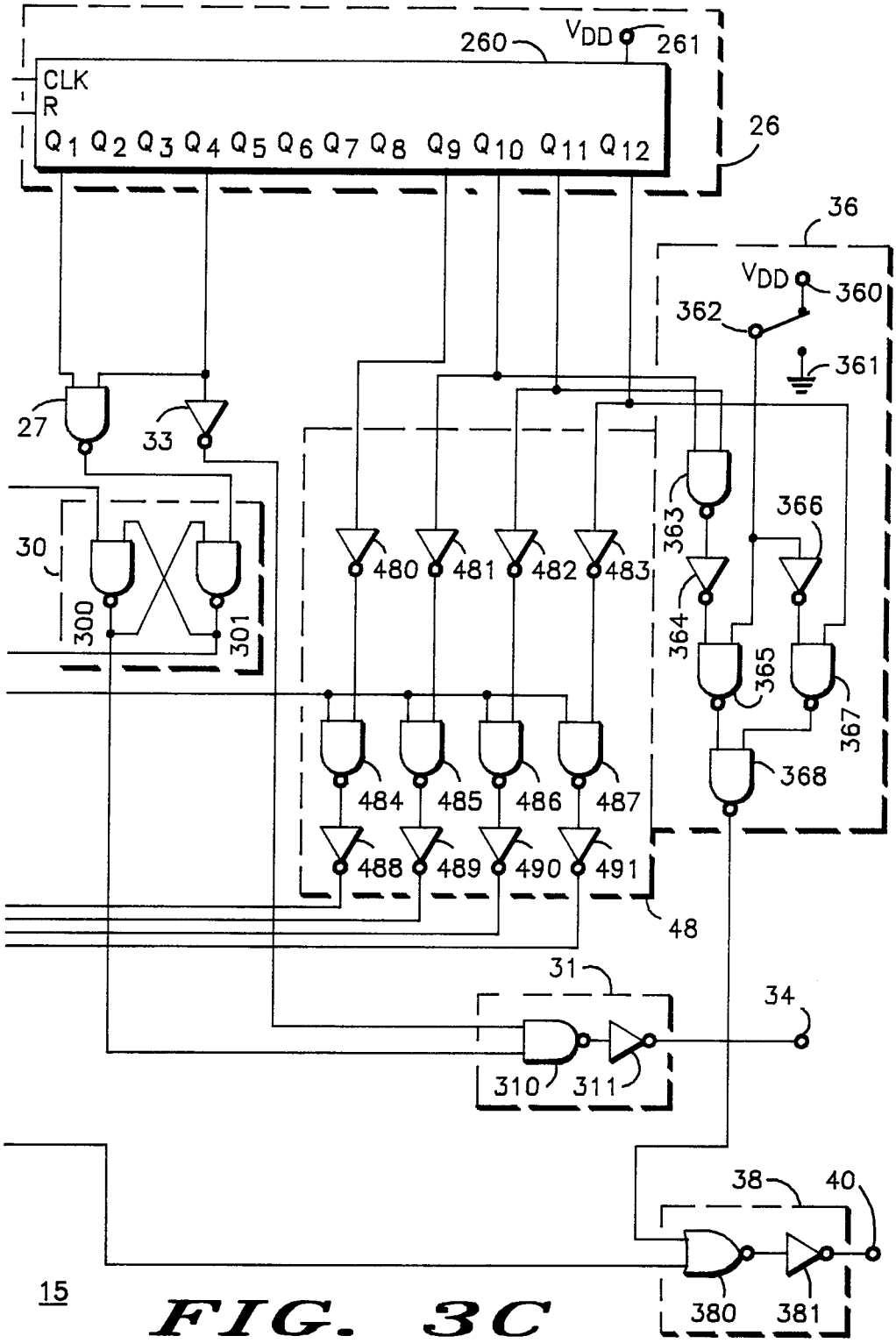

In a schematic diagram of a timer according to the preferred embodiment of the present invention as illustrated in FIG. 3, elements which are similar to those in the embodiment of FIG. 2 are referenced by the same numeral. Terminal 20 is coupled to the input of inverter 22, the output of which is coupled to a first input of a NAND gate 280 within oscillator 28. An output of NAND gate 280 is coupled both to an input of an inverter 281 and to an input of an inverter 296. An output of inverter 281 is coupled to an input of an inverter 282 and to a first end of a capacitor 284. An output of inverter 282 is coupled to a first end of a resistor 283, a second end of which is coupled to a second end of capacitor 284 and to a first end of a resistor 285. A second end of resistor 285 is coupled to a second input of NAND gate 280.

An output of inverter 296 is coupled to an input of an inverter 286 and to a first input of a NAND gate 294. An output of inverter 286 is coupled to a first input of an inverter 287 while a second input of inverter 287 is coupled through a resistor 288 to a terminal 289 suitable for application of a positive potential, $V_{DD}$. An output of inverter 287 is coupled both to an input of an inverter 292 and to a first end of a capacitor 290, a second end of which is coupled to a ground 291. An output of inverter 292 is coupled to a first input of a NAND gate 293, an output of which is coupled to a second input of NAND gate 294 and to an input of an inverter 295. A second input of NAND gate 293 is coupled to an output of NAND gate 294.

In the absence of a power on reset pulse at terminal 20, the input to inverter 22 is low so that its output and, consequently, the first input of NAND gate 280, are high. Assuming that the second input of NAND gate 280 is low, the output of NAND gate 280 is high so that the input to inverter 296 and the input to inverter 281 are high. Because their inputs are high, the output of inverter 296 and the output of inverter 281 are low. Because the output of inverter 281 is low, the first end of capacitor 284 is pulled low and the input to inverter 282 is low. As a result of its low input, the output of inverter 282 goes high, charging capacitor 284 through resistor 283 so that the second input of NAND gate 280 is driven high across resistor 285. When its second input has gone high, both inputs to NAND gate 280 are high so that its output goes low.

As is apparent to one skilled in the art from the above description, elements 280, 281, 282, 283, 284 and 285 form a circuit which oscillates as the second input to NAND gate 280 goes alternately high and low. An output signal from this oscillating circuit is obtained through inverter 296. It is also clear to one skilled in the art that for the duration of a power-on-reset pulse as applied to terminal 20, the output of inverter 22 and hence the first input of NAND gate 280 are held low so that the output of NAND gate 280 is locked high. In this way, oscillator 28 is prevented from oscillating until the end of the power-on-reset pulse.

Alternating high and low outputs of NAND gate 280 result in respectively alternating low and high outputs of inverter 296. A high output from inverter 296 causes the first input of NAND gate 294 and the input of inverter 286 to go high. Until the first input of NAND gate 294 goes high, its output must be high because one of its inputs is low. Therefore, because the second input of NAND gate 293 is tied to the output of NAND gate 294 and because the first input to NAND gate 293 is coupled to the output of inverter 292, which is high until the input to inverter 292 is driven high, the output of NAND gate 293 is low. In response to a high signal at its input, the output of inverter 286 goes low so that the input of inverter 287 goes low causing the output of inverter 287 to rise gradually as capacitor 290 charges toward the positive potential 289 through resistance 288. Unless the first input to NAND gate 294 is maintained high until capacitor 290 has charged sufficiently to bring the input to inverter 292 high so that the output to inverter 292 goes low, causing the output of NAND gate 293 to go high, the oscillating output of inverter 296 is not passed through the circuit comprising elements 286, 287, 288, 289, 290, 291, 292, 293 and 294.

As is clear to one skilled in the art, elements 286, 287, 288, 289, 290, 291, 292, 293 and 294 form a low pass filter. In the absence of such a low pass filter a single failure of a capacitor open, solder points open, lead or bond wire open, or track open allows the oscillator to run at approximately 2 MHz. A low pass filter inhibits the higher frequency from activating the counters of the timer so that arming does not occur. Other possible solutions to the potential problem of a runaway oscillator include the use of a two-stage gate oscillator or a Schottky oscillator. A two-stage oscillator eliminates the free-running oscillations if an open or short circuit occurs. A Schottky oscillator runs at higher frequencies, but the failure mechanisms of an open lead or wire bond, open track, or one open solder joint are eliminated.

Oscillations passed by the above described low pass filter are inverted by inverter 295 to provide an output for oscillator 28.

Frequency divider 24 comprises a type D flip flop 240 having a set input coupled to a ground terminal 241, having a clock input coupled to an output of inverter 295, having a reset input coupled to power-on-reset terminal 20 having a D input coupled to a $\overline{Q}$ output, and having a Q output coupled to a first input of a NAND gate 242. NAND gate 242 also has a disabling second input. An output of NAND gate 242 is coupled to a clock input of a counter 243, a reset input of which is coupled to power-on-reset terminal 20. Counter 243 has seven outputs $Q_1$, $Q_2$, $Q_3$, $Q_4$, $Q_5$, $Q_6$, and $Q_7$, is supplied with positive potential from a terminal 244 suitable for application of a positive potential and has a terminal tied to a ground 245. Counter 243 recycles at every 128th count.

Application of a power-on-reset pulse to terminal 20 sets the Q output of flip-flop 240 and the Q outputs of counter 243 to a low state. Thereafter, because the D input of flip-flop 240 is tied to its $\overline{Q}$ output, with each high pulse from the output of inverter 295, the clocking of flip-flop 240 will result in its Q output going alternately low and high. In this way flip-flop 240 acts to divide the frequency of oscillator 28 by two. Assuming that the second input to NAND gate 242 is held high, each low cycle of the Q output of flip-flop 240 results in a high pulse at the output of NAND gate 242 so that counter 243 is clocked. Counter 243 counts until the seventh of its outputs goes high at which point it provides a high output signal to the clock input of counter 260. After all outputs of counter 243 have gone high on the 128th count all of the outputs of counter 243 are returned to a low level so that counter 243 acts to divide the frequency with which it is clocked by 128. Thus, the combination of flip-flop 240 and counter 243 forms a frequency divider which divides the frequency of oscillator 28 by 256.

Time-of-flight counter 26 comprises a counter 260 coupled to a terminal 261 suitable for application of a positive potential. Counter 260 has a clock input coupled to the $Q_7$ output of counter 243, a reset input coupled to terminal 20, and twelve outputs, $Q_1$, $Q_2$, $Q_3$, $Q_4$, $Q_5$, $Q_6$, $Q_7$, $Q_8$, $Q_9$, $Q_{10}$, $Q_{11}$ and $Q_{12}$. Output $Q_1$ is coupled to a first input and output $Q_4$ is coupled to a second input of a NAND gate 27.

Because the clock input of counter 260 is coupled to output $Q_7$ of counter 243, counter 260 is clocked at 1/256th of the frequency of oscillator 28. Each output goes high according to its number in the sequence of outputs, n, at the clocked count corresponding to the number $2^{n-1}$.

Arming latch 30 comprises a NAND gate 300 having a first input coupled to the output of inverter 22, having an output, and having a second input coupled to an output of a NAND gate 301. A first input of NAND gate 301 is coupled to the output of NAND gate 300 and a second input of NAND gate 301 is coupled to an output of NAND gate 27.

When a power-on reset pulse is applied at terminal 20, the output of inverter 22 pulls the first input of NAND gate 300 low so that its output is high. Because the output of NAND gate 300 is high and because counter 260 is reset so that its outputs $Q_1$ and $Q_4$ are low, causing the output of NAND gate 27 to be high, both inputs of NAND gate 301 are high. Because inputs of NAND gate 301 are high, the output of NAND gate 301 is low so that the second input of NAND gate 300 is low. The high output of NAND gate 300 and the low output of NAND gate 301 are maintained after the output of inverter 22 goes high at the end of the power-on-reset pulse, because the second input of NAND gate 300 is still low and because both inputs of NAND gate 27 are still low. At the ninth count of counter 260, both the $Q_1$ output and the $Q_4$ output of counter 260 go high so that the output of NAND gate 27 goes low, causing the output of NAND gate 301 and hence the second input of NAND gate 300 to go high. Because both inputs of NAND gate 300 are then high, the output of NAND gate 300 goes low. From that point forward, the output of NAND gate 301 is locked high regardless of the level of its second input because the output of NAND gate 300 is locked low in the face of the continued high level of output inverter 22 after the end of the power-on reset pulse. Taking the output of NAND gate 300 as a $\overline{Q}$ output of arming latch 30 and the output of NAND gate 301 as a Q output of arming latch 30, an arming latch is provided having Q and $\overline{Q}$ outputs which switch respectively from high-low to low-high at the ninth count of counter 260.

OR gate 31 is implemented in the detailed schematic of FIG. 3 by a NAND gate 310 having an output coupled to an input of an inverter 311. A first input of NAND gate 310 is coupled to the output of NAND gate 300 and a second input of NAND gate 310 is coupled to the output of an inverter 33, an input of which is coupled to output $Q_4$ of counter 260. An output of inverter 311 is coupled to terminal 34.

From the end of the power-on-reset pulse until after the ninth count of counter 260 the output of NAND gate 300 is high. Likewise, the output of inverter 33 is high until the eighth count of counter 260 because its input, being tied to output $Q_4$ of counter 260, is low until the eighth count of counter 260. Thus, the output of NAND gate 310 is held low causing the output of inverter 311 to be high so that a high level signal is present at terminal 34. At the eighth count of counter 260, the output of inverter 33 goes low, because its input is high. The output of NAND gate 310 goes high causing the output of inverter 311 to go low to provide an inverted arming signal. The output of NAND gate 300 goes low on the ninth count of counter 260 and remains low, therefore, the output of NAND gate 310 remains high and an armed condition is maintained.

Self-destruct decoder 36 comprises a terminal 360 suitable for application of a positive potential and a ground terminal 361. A node 362 is coupled at the manufacturing stage to either node 360 or to node 361 based upon the choice of a shorter or a longer self-destruct time respectively. Self-destruct decoder 36 also comprises a NAND gate 363 having a first input coupled to output $Q_{10}$ of counter 260, having a second input coupled to output $Q_{11}$ of counter 260 and having an output coupled to an input of an inverter 364. An output of inverter 364 is coupled to a first input of a NAND gate 365 which has a second input coupled to node 362. Node 362 is also coupled to an input of inverter 366, an output of which is coupled to a first input of a NAND gate 367. A second input of NAND gate 367 is coupled to the $Q_{12}$ output of counter 260. A first input of a NAND gate 368 is coupled to an output of NAND gate 365 while a second input of NAND gate 368 is coupled to an output of NAND gate 367.

OR gate 38 is implemented in the schematic of FIG. 3 as a NOR gate 380 having a first input coupled to an output of NAND gate 368, having a second input, and having an output coupled to an input of an inverter 381. An output of inverter 381 is coupled to terminal 40.

In the operation of self-destruct decoder 36, assuming that node 362 is coupled to terminal 360, at least one of the inputs of NAND gate 363 is low until both output $Q_{10}$ and $Q_{11}$ of counter 260 go high at count number 1536 of counter 260. At that time, because both of its inputs are high, the output of NAND gate 363 goes low, causing the output of inverter 364 to go high. Because the first input of NAND gate 365 is held high by being coupled to terminal 360 by way of node 362, when the second input of NAND gate 365 goes high because it is coupled to the output of inverter 364, the output of NAND gate 365 goes low. Because output $Q_{12}$ of counter 260 has not yet gone high, the second input to NAND gate 367 is low so that the output of NAND gate 367 is high. Therefore, until the output of NAND gate 365 goes low, both inputs of NAND gate 368 are high so that when the output of NAND gate 365 does go low at count 1536, the output of NAND gate 368 goes from a low to a high state. Thus at least the first input of NOR gate 380 goes high so that the output of NOR gate 380 goes low and the output of inverter 381 goes high to pass as a fire signal to terminal 40.

In the configuration of self-destruct decoder 36 wherein node 362 is coupled to ground 361 and not to terminal 360, the second input of NAND gate 365 is held low because it is coupled through node 362 to ground 361. Thus the output of NAND gate 365 and consequently the first input of NAND gate 368 are always high. The first input to NAND gate 367 is also always high because it is coupled through inverter 366 and node 362 to ground 361. However, the second input to NAND gate 367 is low until output $Q_{12}$ of counter 260 goes high so that the output of NAND gate 367, and hence both inputs of NAND gate 368, is high until output $Q_{12}$ of counter 260 goes high. When output $Q_{12}$ of counter 260 does go high at count 2048 of counter 260, the output of NAND gate 367, and hence the second input of NAND gate 368, goes low so that the output of NAND gate 368 goes high, resulting in a fire signal at terminal 40.

As is clear to one skilled in the art from the above description, causing either or both of the inputs to NOR gate 380 to go high will initiate a fire signal. Therefore, if the second input to NOR gate 380 has not gone high by the time the output to NAND gate 368 goes high, the high output from NAND gate 368 will cause destruction of the projectile. In this way the operation of self-destruct decoder 36 serves to limit the maximum amount of time between the end of the power-on-reset pulse and detonation.

Turning now to a description of an impact latch 32, a NAND gate 320 has a first input coupled to terminal 42, a second input coupled to the output of NAND gate 301 and an output coupled to a first input of a NAND gate 321. An output of NAND gate 321 is coupled to a first input of a NAND gate 322 a second input of which is coupled to the output of NAND gate 301. An output of NAND gate 322 is coupled to a second input of NAND gate 321.

Strobe control 44 comprises a NAND gate 440 having a first input coupled to an output of NAND gate 321, having a second input, and having an output coupled to an input of an inverter 441. An output of inverter 441 is coupled to a first input of a NOR gate 442, a second input of which is coupled to an output of a NOR gate 443. A first input of NOR gate 443 is coupled to the output of NAND gate 322, a second input of NOR gate 443 coupled to an output of NOR gate 442, and the output of NOR gate 443 is coupled to a first input of a NAND gate 444. A second input of NAND gate 444 is coupled to an output of a NAND gate 445. NAND gate 445 has a first input, and has a second input coupled both to the output of NAND gate 444 and to a first input of a NAND gate 446. A second input of NAND gate 446 is coupled to the output of NOR gate 443 while the output of NAND gate 446 is coupled to an input of an inverter 447.

Data gates 48 comprise inverters 480, 481, 482 and 483 which respectively have an input coupled to outputs $Q_9$, $Q_{10}$, $Q_{11}$ and $Q_{12}$ of counter 260 and which respectively have an output coupled to a first input of a NAND gate 484, a first input of a NAND gate 485, a first input of a NAND gate 486, and a first input of a NAND gate 487. A second input of NAND gate 484, a second input of NAND gate 485, a second input of NAND gate 486 and a second input of NAND gate 487 are all coupled to an output of inverter 447. An output of NAND gate 484 is coupled to an input of inverter 488. An output of NAND gate 485 is coupled to an input of inverter 489. An output of NAND gate 486 is coupled to an input of inverter 490. An output of NAND gate 487 is coupled to an input of inverter 491.

Turning now to NAND gate 46, a first input of NAND gate 46 is coupled to the output of inverter 295 in oscillator 28. A second input of NAND gate 46 is coupled to the output of NAND gate 321 in impact latch 32.

A ripple counter 52 comprises a counter 520 having a reset input coupled to the output of NAND gate 322, in latch 32 having a clock input coupled to an output of NAND gate 46, having a $Q_1$ output coupled to the second input of NAND gate 440, having a second output $Q_2$, having a third output $Q_3$, and having a fourth output $Q_4$. Counter 520 further comprises a first input coupled to a terminal 522 suitable for application of a positive potential and a second input coupled to a ground 521.

Counter 520 recycles back to zero on its 16th clocked input in the same fashion that counter 243 in frequency divider 24 recycles at its 128th clocked input. Thus at least one function of counter 520 is to divide the frequency of its input by 16.

An AND gate 58 is implemented in the embodiment of FIG. 3 by a NAND gate 580 having a first input coupled to output $Q_2$ of counter 520, having a second input coupled to output $Q_3$ of counter 520, having a third input coupled to output $Q_4$ of counter 520 and having an output coupled to an input of an inverter 581.

A minimum delay decoder 54 comprises a type D flip-flop 54 having a D input coupled to a terminal 55 suitable for application of a positive potential, having a reset input coupled to the output of NAND gate 322 in impact latch 32, having a clock input coupled to an output of inverter 581, having a set input coupled to a ground 542, having a $\overline{Q}$ output coupled to the first input of NAND gate 445 and having a Q output.

An input of inverter 56 is coupled to the $Q_2$ output of counter 520 while an output of inverter 56 is coupled to a first input of NAND gate 60. A second input of NAND gate 60 is coupled to the Q output of flip-flop 540.

A down counter 50 comprises four flip-flops, 500, 501, 502 and 503, each of which has a D input self-coupled to a $\overline{Q}$ output and each of which has a set input coupled to the output of NAND gate 322 in impact latch 32. Flip-flop 500 has a clock input coupled to an output of NAND gate 60 and has a reset input coupled to an output of inverter 488 in data gates 48. Flip-flop 501 has a clock input coupled to a Q output of flip-flop 500 and a reset input coupled to an output of inverter 489 in data gates 48. Flip-flop 502 has a clock input coupled to a Q output of flip flop 501 and has a reset input coupled to an output of inverter 490 in data gates 48. Likewise, flip-flop 503 has a clock input coupled to a Q output of flip-flop 502 and has a reset input coupled to an output of inverter 491 in data gates 48.

An AND gate 62 is implemented in the embodiment of FIG. 3 through the use of a NAND gate 620, a NAND gate 621 and a NOR gate 622. NAND gate 620 has a first input coupled to the Q output of flip-flop 540 in minimum delay decoder 54, has a second input coupled to the $\overline{Q}$ output of flip-flop 500 in down counter 50, and has a third input coupled to the $\overline{Q}$ output of flip-flop 501 in down counter 50. NAND gate 621 has a first input coupled to the $\overline{Q}$ output of flip-flop 502 in down counter 50, and has a second input coupled to the $\overline{Q}$ output of flip-flop 503 in down counter 50. NAND gate 620 has an output coupled to a first input of NOR gate 622 while NAND gate 621 has an output coupled to a second input of NOR gate 622. An output of NOR gate 622 is coupled to the second input of NOR gate 380.

As is understood by one skilled in the art, when used in combination with time of flight counter 26, impact latch 32, OR gate 38, strobe control 44, NAND gate 46, data gates 48, down counter 50, ripple counter 52, minimum delay decoder 54, terminal 55, inverter 56, AND gate 58, NAND gate 60, and AND gate 62 provide a variable impact delay.

In the operation of impact latch 32, at least one input to NAND gate 320 is low until after the output of NAND gate 301 in arming latch 30 goes high at the time when output $Q_4$ of counter 260 goes high, and after an impact signal is received through terminal 42. Because the first input of NAND gate 322 is also coupled to the output of NAND gate 301, the output of NAND gate 322 is high until the output of NAND gate 301 goes high. Thus, the output of NAND gates 320 and 322 are high and the output of NAND gate 321 is consequently low before impact. The high level signal at the output of NAND gate 322 holds the set inputs of flip flops 500, 501, 502 and 503 in a set condition and the reset inputs of counter 520 and flip-flop 540 in a reset condition. By being tied to the output of NAND gate 321, the second input of NAND gate 46 is held low before impact so that the output of NAND gate 46 remains high regardless of the level at its first input.

At impact, the first input of NAND gate 320 goes high so that both inputs to NAND gate 320 are high after the ninth count of counter 260 when both the $Q_1$ and $Q_4$ outputs of counter 260 go high. Consequently, the output of NAND gate 320 goes low so that the output of NAND gate 321 goes high. Because both of its inputs are high, the output of NAND gate 322 goes low, locking the output of NAND gate 321 in a high state regardless of any change in the impact signal level because the output of NAND gate 301 and hence the second input of NAND gate 322 are held high after the ninth count of counter 260. Because at least the second of its inputs, being tied to the output of NAND gate 321, is always high, the oscillation of the level of the signal at the first input to NAND gate 46 causes the output of NAND gate 46 to oscillate synchronously with the output of oscillator 28 so that counter 520 is clocked at the rate of oscillator 28.

Figure 4:
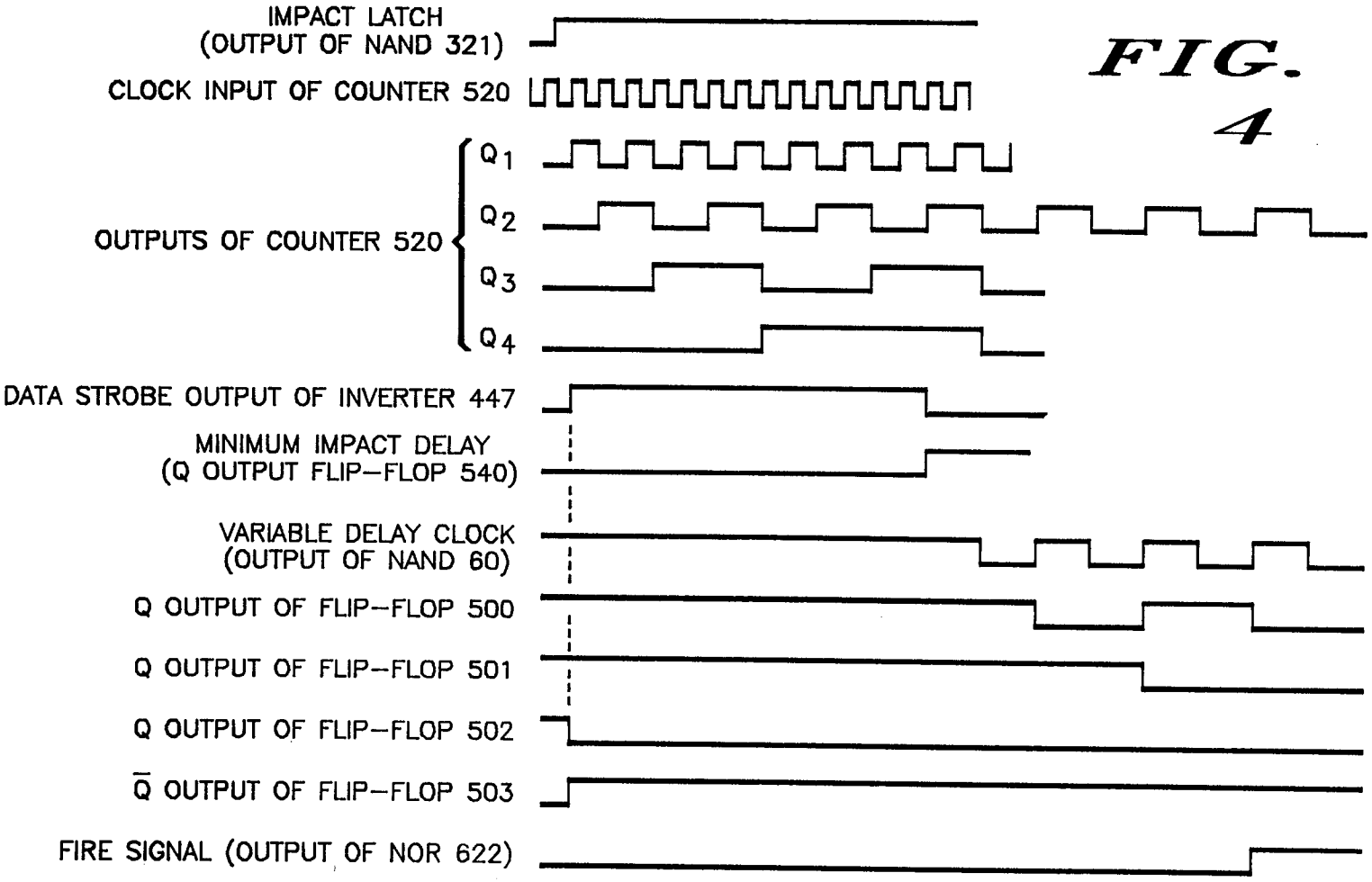
FIG. 4 is a timing diagram for the embodiment of FIG. 3.

By a comparison of the structure of FIG. 3 with the timing diagram in FIG. 4, the operation of the impact delay according to the present invention is readily understood. As shown in FIG. 4, when counter 520 is first clocked by the rising edge of a pulse at its clock input after impact, the $Q_1$ output of counter 520 goes high. When the $Q_1$ output of counter 520 first goes high it causes the second input of NAND gate 440 in strobe control 44 to go high. Thus, both of the inputs of NAND gate 440 are high because its first input is coupled to the output of NAND gate 321 which goes high at impact and the output of NAND gate 440 goes low. Inverter 441 inverts the output of NAND gate 440 so that the first input of NOR gate 442 goes high, causing the output of NOR gate 442 to go low. Because the first input of NOR gate 443 is made low by being coupled to the output of NAND gate 322, and the second input of NOR gate 443 is made low by being coupled to the output of NOR gate 442, the output of NOR gate 443 goes high. The high output of NOR gate 443 maintains the second input of NOR gate 442 in a high state so that the output of NOR gate 442 is maintained in a low state. Because the output of NOR gate 442 is fixed high, the operation of strobe control 44 is no longer influenced by changes in the level of the signal from the $Q_1$ output of counter 520.

Because the output of NAND gate 322 is low after impact, the second input to NAND gate 242 in frequency divider 24 is made low so that its output goes high. Thus, the low output of NAND gate 322 indicative of an impact causes NAND gate 242 to remain in a high state so that frequency divider 24 is disabled and counter 260 is stopped at impact.

Because the $\overline{Q}$ output of flip flop 540 is reset in a high state before impact, the first input of NAND gate 445 in strobe control 44, to which $\overline{Q}$ output of flip-flop 540 is coupled, is also high. Until its first input goes high as a result of an impact related signal, the output of NAND gate 444 is high because at least its first input is low. Thus, the second input of NAND gate 445, which is coupled to the output of NAND gate 444, is high, causing the output of NAND gate 445 and the second input to NAND gate 444 to which it is coupled to be low. Therefore, the output signals from NAND gate 444 and NAND gate 445 will remain the same as long as the $\overline{Q}$ output of flip-flop 540 is in a high state, but as soon as the $\overline{Q}$ output of flip-flop 540 goes low, the output of NAND gate 445 goes high, causing both inputs of NAND gate 444 to be high so that its output is low.

When the output of NOR gate 443 goes high after impact, the second input of NAND gate 446 to which it is coupled goes high. Because the first input to NAND gate 446 is already high due to the high level of the output of NAND gate 444, the output of NAND gate 446 goes low. As a result, the output of inverter 447 and the second input of each of NAND gate 484, NAND gate 485, NAND gate 486 and NAND gate 487 go high. Thus, if any of outputs $Q_9$, $Q_{10}$, $Q_{11}$ and $Q_{12}$ of counter 260 are low, the respective outputs of any of inverters 480, 481, 482, and 483 are high and the respective first inputs of any of NAND gates 484, 485, 486 and 487 are high. Any of these NAND gates having both inputs high will have a low output inverted by the respective inverter 488, 489, 490 and 491 to which it is coupled and respectively applied to reset input of any of flip flop 500, 501, 502 and 503 to reset the $\overline{Q}$ outputs of those flip flops to a high level.

In the timing diagram of FIG. 4, it is assumed that outputs $Q_9$, $Q_{10}$, $Q_{11}$ and $Q_{12}$ of counter 260 have the respective levels low, low, high, high. Assuming that the output of oscillator 28 varies at 58,000 hertz so that counter 260 is clocked at 1/256th of that rate, or a count every 4.41 microseconds, this output of counter 260 indicates a flight time of about 13.56 seconds.

When outputs $Q_2$, $Q_3$, and $Q_4$ are all high at the 14th clocking of counter 520, all of the inputs of NAND gate 580 are high so that its output goes low which causes the output of inverter 581 to go high, clocking flip-flop 540 to change state from its reset condition to a condition where the Q output of flip flop 540 is high and the $\overline{Q}$ output of flip-flop 540 is low. Further clocking of flip-flop 540 merely maintains this condition because the D input of flip-flop 540 is tied to a source of positive potential through terminal 541.

Because the $\overline{Q}$ output of flip flop 540 is low, the first input to NAND gate 445 in data strobe 44 to which it is coupled goes low so that the output of NAND gate 445 goes high. A high output of NAND gate 445 causes the second input of NAND gate 444 to be high so that both of its inputs are high causing its output to go low. As a result, the output of NAND gate 446 goes high because at least one of its inputs, its first input, is low. The output of inverter 447 then goes low so that the second input of each of NAND gates 484, 485, 486 and 487 goes high and as a consequence the output of each of inverters 488, 489, 490 and 491 goes low to end the resetting of flip-flops 500, 501, 502 and 503. This chain of events is illustrated in FIG. 4 wherein it is shown that the output of inverter 447 falls when the $Q_2$, $Q_3$ and $Q_4$ outputs of counter 520 have all gone high. Thus, the first cycling of counter 520 provides a window for data strobe 44 during which data is strobed from counter 260 to down counter 50.

It can also be seen in FIG. 4 that a change of state of flip flop 540 provides a minimum impact delay during which down counter 50 is maintained in a reset condition. In the example of FIG. 4, where the output of flip flop 540 changes state at the 14th count of counter 520 and where counter 520 is clocked every 17.24 microseconds (corresponding to an oscillator frequency of 58,000 hertz), the minimum impact delay provided by the cycling of flip-flop 540 is about 241.4 microseconds.

Thereafter, because the second input of NAND gate 60 is maintained high, the cycling of output $Q_2$ of counter 520 causes the first input of NAND gate 60 to cycle alternately high and low so that the output of NAND gate 60 cycles alternately low and high to clock flip-flop 500. NAND gate 60 thereby acts as a variable delay clock. Where flip-flops 500, 501, 502 and 503 are clocked on the rising edge of any input clock pulse, it can be seen as shown in FIG. 4 that on the first rising edge of an output pulse from NAND gate 60, the Q output of flip flop 500 changes state from high to low, assuming the resetting of down counter 50' for the count at impact of counter 260 as assumed above. Because the D input is coupled to the $\overline{Q}$ output for each of flip-flops 500, 501, 502 and 503, each of these flip-flops changes state in sequence on the $2^M$ output pulse from NAND gate 60 where M equals respectively 0, 1, 2, and 3. Because the $Q_2$ output of counter 250 goes high on every fourth oscillator pulse, up to 64 additional oscillator pulses or about 1.1 msec. of impact delay can be added by the combination of counter 520 and down counter 50. A partial range of theoretical delays after impact as a function of flight time are given in Table 1 wherein an uncertainty of half an oscillator pulse is assumed in the change of state of flip-flop 540 as follows:

TABLE 1

THEORETICAL DELAY AFTER IMPACT AS A FUNCTION OF FLIGHT TIME

| Flight Time (seconds) | Delay After Impact (Microseconds) | Uses of Pulses of Oscillator 28 |
|---|---|---|
| 0–1.1 | 241 | 14.0 + 0 |
| 1.1–2.2 | 310 | 14.0 + 4 |
| 2.2–3.3 | 379 | 14.0 + 8 |
| 3.3–4.4 | 448 | 14.0 + 12 |
| 4.4–5.5 | 517 | 14.0 + 16 |

TABLE 1-continued

THEORETICAL DELAY AFTER IMPACT AS A FUNCTION OF FLIGHT TIME

| Flight Time (seconds) | Delay After Impact (Microseconds) | Uses of Pulses of Oscillator 28 |
|---|---|---|
| 5.5–6.6 | 586 | 14.0 + 20 |
| 6.6–7.7 | 655 | 14.0 + 24 |
| 7.7–8.8 | 724 | 14.0 + 28 |
| 8.8–9.9 | 793 | 14.0 + 32 |
| 9.9–11.0 | 862 | 14.0 + 36 |
| 11.0–12.1 | 931 | 14.0 + 40 |
| 12.1–13.2 | 1000 | 14.0 + 44 |
| 13.2–14.3 | 1069 | 14.0 + 48 |
| 14.3–15.4 | 1138 | 14.0 + 52 |
| 15.4–16.5 | 1207 | 14.0 + 56 |
| 16.5–17.6 | 1276 | 14.0 + 60 |
| 17.6–18.7 | 1345 | 14.0 + 64 |
| 18.7–19.8 | 1414 | 14.0 + 68 |

Assuming the resetting of flip-flops 500, 501, 502 and 503 for a flight time of 13.56 seconds as above, before the clocking of down counter 50, the $\overline{Q}$ outputs of flip flops 500, 501, 502 and 503 are respectively high, high, low and low. Therefore, on the first pulse from NAND gate 60, the $\overline{Q}$ outputs of flip-flops 500 and 501 go low while the output of flip-flop 502 goes high. On the second pulse from NAND gate 60, the $\overline{Q}$ output of flip-flop 500 goes high. On the third pulse the $\overline{Q}$ output of flip-flop 501 goes high and the output of flip-flop 500 goes low. On the fourth output pulse of NAND gate 60, the $\overline{Q}$ output of flip-flop 500 goes high again so that the $\overline{Q}$ outputs of all three flip-flops 500, 501 and 502 are high. This process continues for a total of 12 output pulses from NAND gate 60 which is equivalent to 48 oscillator pulses. At the end of this process all of the $\overline{Q}$ outputs of flip-flops 500, 501, 502 and 503 are high so that all of the inputs to NAND gate 620 and NAND gate 621 are high, causing their outputs to go low. As a consequence, both inputs to NOR gate 622 are low so that its output is high, causing the output of NOR gate 380 to go low and the output of inverter 381 to go high. In this way a fire signal is passed through terminal 40 about 1.069 μsec (241.4 μsec minimum +827.6 μsec variable) after impact.

Figure 5:
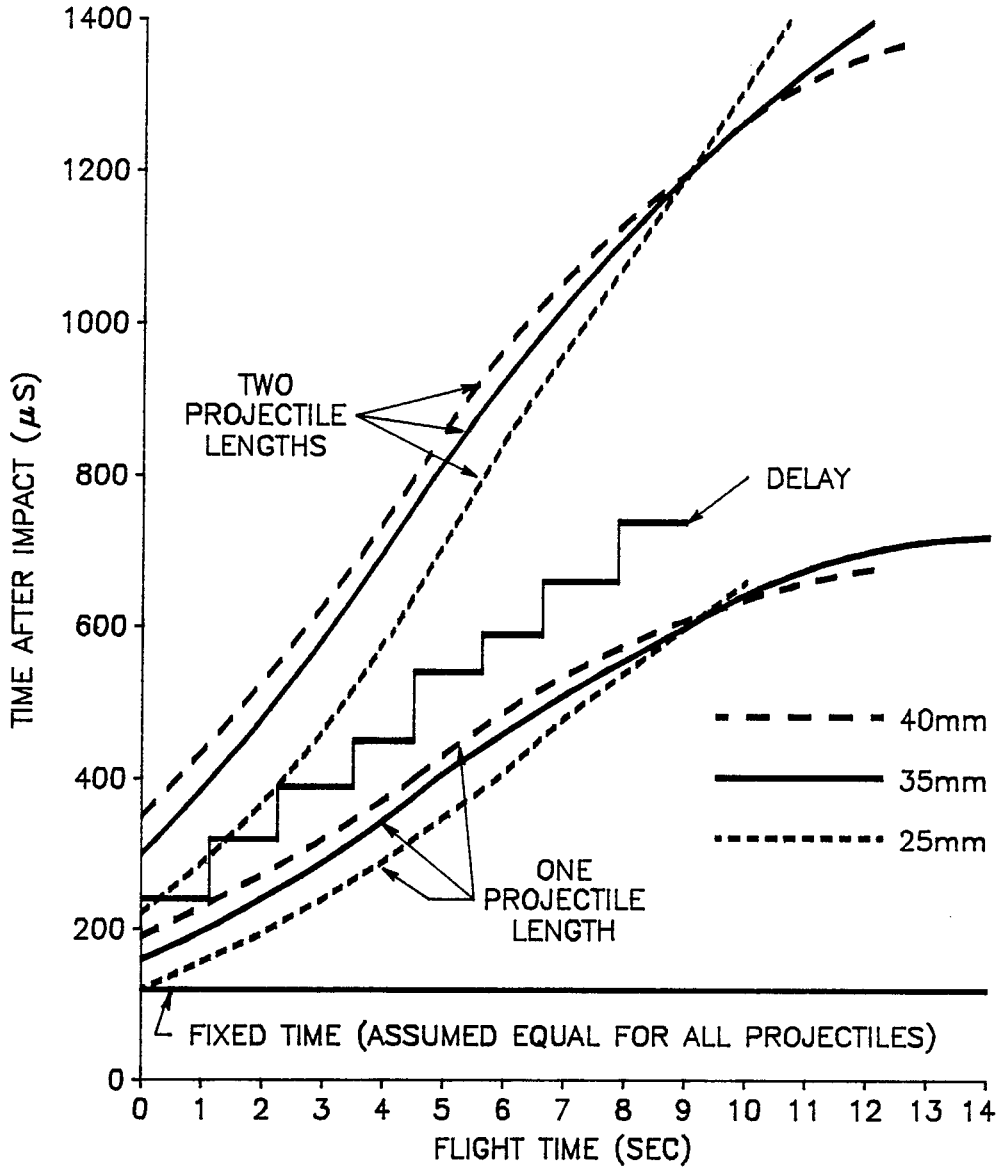
FIG. 5 is a graph illustrating the projected performance of a projectile according to the embodiment of FIG. 3.

FIG. 5 illustrates a projected impact delay and its relationship to the time needed for a 25 mm, a 35 mm and a 40 mm projectile to penetrate to various projectile lengths through a minimal target surface after impact. As is shown therein considering the electronic time delay only, the impact delay of the present invention is projected to allow penetration between one and two projectile lengths into a target before detonation. In a real situation, there is also a delay due to explosive train propagation which is a function of the explosive components, firing voltage and the size of the firing capacitor. The electronic impact delay according to the present invention may be adjusted to maintain the total time delay within the desired limits shown in FIG. 5 based upon delays for different explosive trains.

While the present invention has been described in terms of a preferred embodiment, further modifications and improvements will occur to those skilled in the art. For example, the frequency of oscillator 28 which sets the clock intervals and the logical levels of outputs indicative of various conditions can be varied as required for particular applications using only mechanical skill. Furthermore, it is obvious for one skilled in the art that logic gates were shown between functional blocks in FIG. 2 and for the purpose of simplifying the description and may be included within the functional blocks without exceeding the scope of the present invention. In addition, although positive logic was used throughout the Description of the Preferred Embodiment, negative logic may be employed by making structural changes which require no more than mechanical skill in the art. Also, as is clear to one skilled in the art the self-destruct logic need not be limited to two settings but may have further settings for various self-destruct delays implemented by additional logic. Likewise, the down counter need not be limited to four inputs. Furthermore, the minimum impact delay implemented by ripple counter 52 minimum delay decoder 54 and the associated logic may be eliminated by coupling the down counter to the oscillator with obvious modifications to provide appropriate frequency division.

We desire it to be understood, therefore, that this invention is not limited to the particular form shown and we intend in the appended claims to cover all such equivalent variations which come within the scope of the invention as described.

We claim:

1. A timer for a fuze actuation system, having an impact sensor and having an output circuit, comprising:
- an oscillator;
- a frequency divider coupled to said oscillator;
- a time-of-flight counter coupled to said frequency divider;
- an arming latch coupled to said time-of-flight counter;
- an impact latch coupled to said arming latch and to the impact sensor;
- a strobe control coupled to said impact latch;
- a down counter coupled to said impact latch and coupled to said oscillator; and
- a plurality of data gates, each coupled to said strobe control, each coupled to said down counter and each coupled to said time-of-flight counter.

2. The timer according to claim 1, further comprising:
- a self-destruct decoder coupled to said time-of-flight counter; and
- a logic gate having a first input coupled to said time-of-flight counter, having a second input coupled to said down counter, and having an output providing a firing signal.

3. The timer according to claim 1, further comprising a logic gate having a first input coupled to said time-of-flight counter, having a second input coupled to said arming latch and having an output providing an arming signal.

4. The timer according to claim 1, further comprising a ripple counter coupled to said oscillator, coupled to said strobe control, and coupled to said down counter.

5. The timer according to claim 4, further comprising a logic gate having a first input coupled to said oscillator, having a second input coupled to said impact latch and having an output coupled to said ripple counter.

6. The timer according to claim 4, further comprising a minimum delay decoder coupled to said ripple counter, coupled to said impact latch, coupled to said strobe control, and coupled to said down counter.

7. The timer according to claim 6, further comprising a logic gate having a first input coupled to said ripple counter, having a second input coupled to said minimum delay decoder and having an output coupled to said down counter.

8. A fuze comprising:
a power supply;
a power on reset circuit coupled to said power supply;
an impact sensor;
an output circuit coupled to said power supply;
a detonator coupled to said output circuit;
an oscillator coupled to said power on reset circuit and coupled to said power supply;
a frequency divider coupled to said oscillator coupled to said power on reset circuit and coupled to said power supply;
a time-of-flight counter coupled to said frequency divider, coupled to said power on reset circuit and coupled to said power supply;
an arming latch coupled to said time-of-flight counter, coupled to said power on reset circuit, and coupled to said output circuit;
an impact latch coupled to said arming latch and to said impact sensor;
a strobe control coupled to said impact latch;
a down counter coupled to said impact latch coupled to said oscillator, and coupled to said output circuit; and
a plurality of data gates, each coupled to said strobe control, each coupled to said down counter and each coupled to said time-of-flight counter.

9. The fuze according to claim 8, further comprising:
a self-destruct decoder coupled to said power supply and coupled to said time-of-flight counter; and
a logic gate having a first input coupled to said time-of-flight counter, having a second input coupled to said down counter, and having an output providing a firing signal.

10. The fuze according to claim 8 further comprising a logic gate having a first input coupled to said time-of-flight counter having a second input coupled to said arming latch and having an output providing an arming signal.

11. The fuze according to claim 8 further comprising a ripple counter coupled to said oscillator, coupled to said strobe control, coupled to said down counter and coupled to said power supply.

12. The fuze according to claim 11, further comprising a logic gate having a first input coupled to said oscillator, having a second input coupled to said impact latch and having an output coupled to said ripple counter.

13. The fuze according to claim 11, further comprising a minimum delay decoder coupled to said ripple counter, coupled to said impact latch, coupled to said power supply, coupled to said strobe control, and coupled to said down counter.

14. The fuze according to claim 13, further comprising a logic gate having a first input coupled to said ripple counter, having a second input coupled to said minimum delay decoder and having an output coupled to said down counter.

15. A method for delaying detonation of a projectile, having a fuze, after an impact of the projectile with an object, the fuze, having a time-of-flight counter providing an output count, and having a down counter having a settable count and providing a firing signal at a predetermined count comprising the steps of:
gating the count from the time-of-flight counter to the down counter after impact;
setting the settable count of the down counter using the count gated from the time-of-flight counter;
disabling the down counter for a minimum delay after impact and before decrementing the down counter; and
decrementing the down counter to the predetermined count.

* * * * *